United States Patent [19]

Puariea

[11] 4,266,486

[45] May 12, 1981

[54] RAIL CAR DOOR LINKAGE

[75] Inventor: Douglas A. Puariea, St. Paul, Minn.

[73] Assignee: The Maxson Corporation, St. Paul, Minn.

[21] Appl. No.: 71,036

[22] Filed: Aug. 30, 1979

[51] Int. Cl.[3] ..... B61D 9/00

[52] U.S. Cl. ..... 105/276; 105/272; 298/17.6; 298/22 D

[58] Field of Search ..... 105/272, 273, 274, 276, 105/261 R, 263, 271; 298/17.5, 17.6, 18, 22 D, 23 R, 23 D, 23 MD

[56] References Cited

U.S. PATENT DOCUMENTS

| | | | |
|---|---|---|---|
| 1,813,570 | 7/1931 | Flowers | 105/276 |
| 1,965,097 | 7/1934 | Cartzdafner | 105/272 X |
| 1,977,621 | 10/1934 | Burner | 105/273 |
| 2,012,595 | 8/1935 | Anderson | 105/276 |
| 2,195,772 | 4/1940 | Farrell | 105/276 X |
| 3,166,022 | 1/1965 | Flowers | 105/276 X |

*Primary Examiner*—Randolph A. Reese
*Attorney, Agent, or Firm*—Neil B. Schulte

[57] ABSTRACT

A door linkage for a side dump railroad car operable to automatically lower the door on the low side of the car when the car body is tilted to dump its contents thereof.

9 Claims, 3 Drawing Figures

FIG. 1
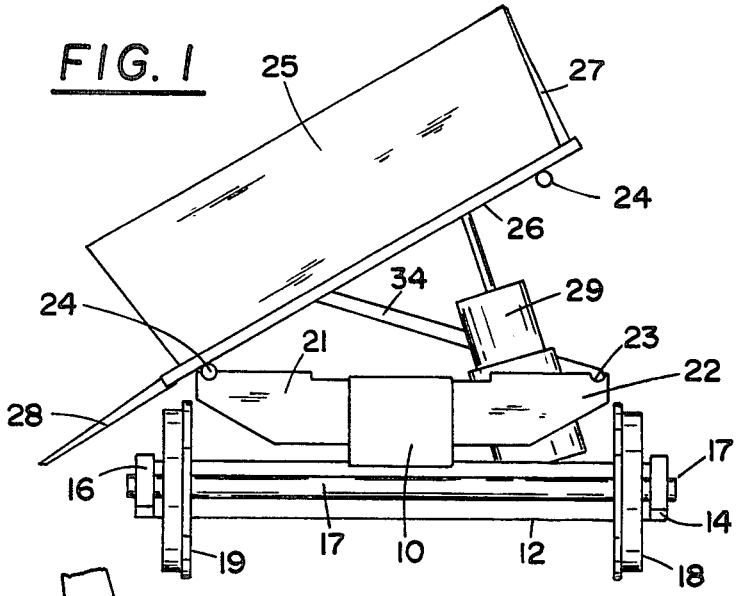
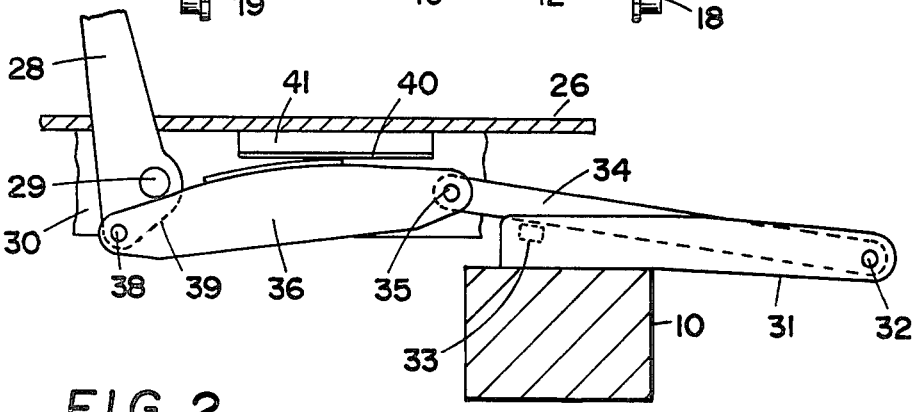
FIG. 2
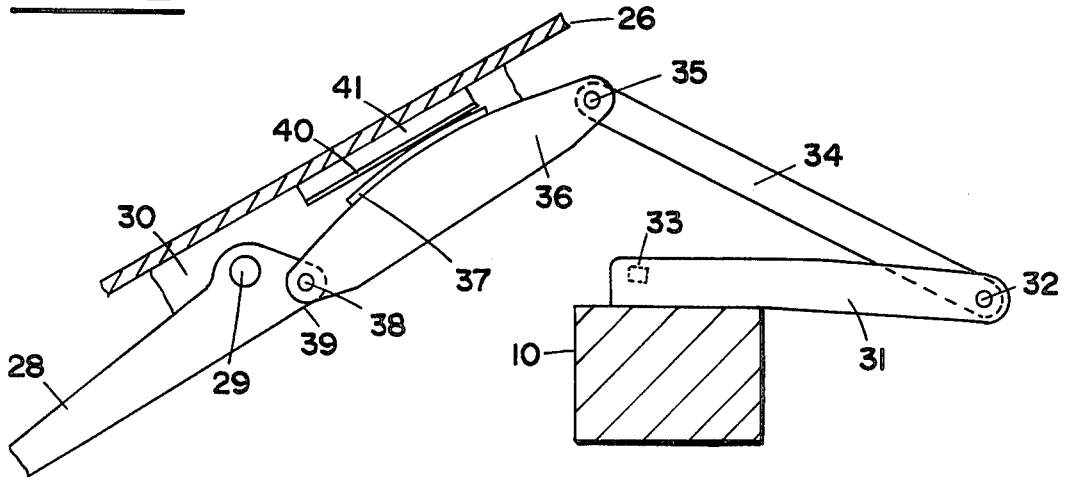
FIG. 3

RAIL CAR DOOR LINKAGE

BACKGROUND OF THE INVENTION

Side dump railway cars typically use a tilting bed which is raised on one side by air cylinders or the like so as to cause the contents of the car to slide out of the opposite side. As the bed is raised it is necessary to open the door on the low side to allow the contents to exit the car. Various prior art arrangements have been tried to accomplish this purpose but they are usually quite complex and therefore expensive. The present invention however, provides a door opening linkage which is straightforward and reliable and which can be contained completely in the area immediately below the tilt bed where it is well protected from the weather and relatively simple in design and inexpensive.

BRIEF SUMMARY OF THE INVENTION

In brief, my invention incorporates side doors on the car which are pivoted on the edge of the tilt bed at their bottom edge. A portion of the door extending below the pivot point will rotate inward when the door lowers but is prevented from doing so by an articulated linkage connected thereto. The articulated linkage is also connected at the other side of the car at a pivot point coincident with the rotational axis of the tilt bed itself. Thus, when the tilt bed is raised the door linkage on the high side simply rotates with the car causing no door movement whatsoever on the high side of the car. This is an improvement over prior art schemes in which both doors may be subjected to some movement during the tilting of the bed.

As the tilt bed raises more room is provided beneath the underside of the tilt bed and the main frame of the car. The articulated linkage can expand in this additional space thus decreasing its overall length and allowing the extended portion of the door below the door pivot to move inward so that the door can lower. Thus, the underside of the tilt bed forms a portion of the door mechanism in that it provides a bearing surface against which the articulated linkage slides. Thus, the overall number of parts is reduced and the arrangement is made less costly and more reliable. It may therefore be seen that it is an object of my invention to provide an improved side dump car door linkage which is less expensive, more compact, and more efficient. Further objects and advantages will become apparent from the following detailed description and drawings.

BRIEF DESCRIPTION OF THE DRAWINGS

FIG. 1 is a schematic end view of a typical rail car with a tilt bed and doors operated by the linkage of my invention.

FIG. 2 is a fragmentary drawing of one of the door linkage subassemblies utilized in the present invention. FIG. 2 shows the door in a closed position with the tilt bed flat.

FIG. 3 is a fragmentary view showing the same elements as FIG. 2 but the door open and the tilt bed raised.

DESCRIPTION OF THE PREFERRED EMBODIMENT

In FIG. 1 a simplified schematic drawing of a side dump rail car is shown having a longitudinal main frame 10 carried on suitable cross members 12. Cross members 12 connect to wheel support members 14 and 16 which in turn rest upon an axle 17. Axle 17 carries a pair of wheels 18 and 19. Such arrangements are well known to those skilled in the art. Extending out from the sides of mainframe 10 are a pair of underframe bolsters 21 and 22 which contain cradles 23 at the outboard ends within which rest pivot bearings 24. Pivot bearings 24 are fastened to the bottom side of the car 25. This bottom side of car 25 is referred to as the tilt bed in the instant specification and numbered 26. A pair of doors 27 and 28 are pivoted on the sides of the car 25 at their lower ends and caused to open when the tilt bed 26 is raised by a telescoping cylinder 29 as shown in FIG. 1. In practice there will probably be a pair of telescoping cylinders 29 on each side of the car although only one is visible in FIG. 1. When the tilt bed 26 is raised to the position shown in FIG. 1, door 28, the door on the lower side of the car, is caused to open to the position shown by the linkage of the present invention which is described in greater detail with respect to FIGS. 2 and 3.

In FIG. 2 a fragmentary section through the car is presented for the condition when the tilt bed is flat and the door closed. In FIG. 3 the same elements as FIG. 2 are presented for the situation when the tilt bed is raised to its full height and door 28 is open. Both figures show only one set of door opening articulated linkages although it is contemplated that four such linkages will be used for each door for a total of eight on an individual car. The linkages shown in FIGS. 2 and 3 are for door 28 on the left side of the car as shown in FIG. 1. Door 28 is pivoted on a pivot pin 29. Pin 29 is mounted on one of the numerous cross ribs 30 which extend across the underside of tilt bed 26. Welded to the top of mainframe 10 are a pair of linkage support members 31 which are generally identical in shape and extend out in a direction to the opposite side of the car from the door being operated. Mounted between linkage supports 31 are pivot pin 32 and a shear pin 33. A linkage arm 34 is pivoted on pin 32 at one end and pivoted on a pin 35 at its opposite end. A pair of sliding members 36 of approximately identical shape are connected together by a curved wear plate 37 welded to the top edges of plates 36. Pivot pin 35 is supported between plates 36 and linkage arm 34 extends between plates 36 to pivot pin 35. Another pin 38 is mounted between sliding plates 36 at the opposite end. Pin 38 extends through an extended portion 39 of door 28. Wear plate 37 slides against another wear plate 40 which is mounted by means of a support member 41 to the underside of tilt bed 26. The linkage operates as described hereinafter as it goes from the level or flat position shown in FIG. 2 to the fully raised position in FIG. 3. The axis of pivot pin 32 is designed to coincide with the axis of pivot bearing 24 when it rests in cradle 23 on the right hand side of the car. Accordingly, if the left hand side of the car were raised, that is, in the direction opposite from that shown in FIG. 1, the linkage of FIG. 2 would simply pivot about pin 32 having no effect whatsoever on door 28. In this case door 27 would be operated by a suitable linkage similar to that shown in FIG. 2 but having a mirror image arrangement. However, when the tilt bed is raised as shown in FIG. 1 with the left hand side becoming the lower side then door 28 is allowed to lower by the linkage under tilt bed 26. As can be seen in FIG. 2, pivot pin 35 is a little bit higher than pivot pins 32 and 38 so that linkage arm 34 and sliding plate 36 form an overcenter articulated linkage which presses upwards against wear plate 40 on the underside of tilt bed 26. In general the weight of the contents of the car will bear against door 28 causing it to swing downward about pivot pin 29 if it can. In fact, door 28 will lower under its own weight except for the restraining influence of the articulated linkage formed by linkage bar 34 and sliding plate 36 which hold the extended portion 39 of door 28 at a specific location. However, as tilt bed 26 is raised, pivot pin 35 is allowed also to raise following the underside of tilt bed 26. As this happens sliding plates 36 slide along wear plates 40 to the position shown in FIG. 3. Pin 38 is allowed also to move to the right slightly so that door 28 can be lowered to the position shown in FIGS. 1 and 3.

It should be noted that if in the lowering of the car door 28 encounters an obstruction it is still free to rotate upwards with the sliding plates 36 simply dropping away from wear plates 40 until the obstruction is removed or cleared. Accordingly, door 28 is not forced to open at a given rate but allowed to open in an amount appropriate to the dumping action and as required.

It should also be noted that if door 28 is frozen in place or otherwise unable to open it will be forced to open by shear pin 33. As the tilt bed 26 begins to rise, pivot pin 38 drops slightly and lowers sliding plate 36 and linkage arm 34 onto shear pin 33. Pin 33 pushes up on arm 34 exerting a large opening force on door 28. If door 28 remains shut, shear pin 33 is designed to break loose and protect the mechanism.

As the tilt bed is once again lowered wear plate 40 will bear against curved wear plate 37 forcing sliding members 36 and linkage arm 34 downward. The total distance between pins 32 and 38 will increase with enormous leverage being available to rotate the extended portion 39 of door 28 down and outward so as to raise door 28 to the upright position again.

I claim:

1. A door linkage for a side dump railway car comprising in combination:

a main frame carried on wheeled trucks and having pivot support means on each side thereon;

a tilting bed resting on said pivot support means, said bed having a car body thereon and at least one side door pivoted at the side thereof;

a sliding means having first and second ends and adapted to bear against and slide along the underside of said tilting bed at a location on said tilting bed that moves upward during tilting of said tilting bed;

an extension portion on the bottom of said side door below the point at which the side door pivots on the tilting bed pivotally connected to said sliding means at the first end of said sliding means by a first pivotal connection;

a linkage arm having first and second ends;

linkage support means extending out from said main frame on the side of the car opposite from said side door, said linkage support means pivotally connected at its outboard end to the first end of said linkage arm by a second pivotal connection; and third pivotal connection means between the second end of said sliding means and the second end of said linkage arm.

2. The linkage arrangement of claim 1 including first wear plate means on the underside of said tilting bed and second wear plate means on the top of said sliding means, said wear plates positioned to slidably engage each other during the tilting of said tilt bed.

3. The linkage arrangement of claim 1 in which said third pivotal connection means between said sliding means and said linkage arm is normally maintained above the height of the line connecting the first pivotal connection and the second pivotal connection.

4. The linkage arrangement of claim 3 in which the pivot axis of said second pivotal connection is substantially coincident with the pivot axis of said pivot support means for the tilt bed on the same side of the car.

5. The linkage arrangement of claim 4 including first wear plate means on the underside of said tilt bed and second wear plate means on the top of said sliding means, said wear plates positioned to slidably engage each other during the tilting of said tilt bed.

6. The linkage arrangement of claim 1 including downward motion blocking means comprising a shear pin positioned just under said linkage arm to force said linkage arm and said sliding means upward against the underside of said tilting bed momentarily at the moment the bed starts to tilt if the door does not open.

7. The linkage arrangement of claim 6 in which said third pivotal connection means between said sliding means and said linkage arm is normally maintained above the height of the line connecting the first pivotal connection and the second pivotal connection.

8. The linkage arrangement of claim 7 in which the pivot axis of said second pivotal connection is substantially coincident with the pivot axis of said pivot support means for the tilt bed on the same side of the car.

9. The linkage arrangement of claim 8 including first wear plate means on the underside of said tilt bed and second wear plate means on the top of said sliding means, said wear plates positioned to slidably engage each other during the tilting of said tilt bed.

* * * * *